United States Patent [19]

Ura

[11] 4,277,767

[45] Jul. 7, 1981

[54] DEFLECTION YOKE

[75] Inventor: Mitsugu Ura, Yokohama, Japan

[73] Assignee: Hitachi, Ltd., Tokyo, Japan

[21] Appl. No.: 115,407

[22] Filed: Jan. 25, 1980

[30] Foreign Application Priority Data

Jan. 26, 1979 [JP] Japan ..... 54-7733[U]

[51] Int. Cl.[3] ..... H01F 5/00

[52] U.S. Cl. ..... 335/210; 335/213

[58] Field of Search ..... 335/210, 212, 213

[56] References Cited

U.S. PATENT DOCUMENTS

| | | | |
|---|---|---|---|
| 3,757,224 | 9/1973 | Fedorko et al. | 335/213 X |
| 4,126,842 | 11/1978 | Barouh et al. | 335/213 |
| 4,128,824 | 12/1978 | Mirsch | 335/213 |
| 4,175,261 | 11/1979 | Sawada | 335/213 |
| 4,181,908 | 1/1980 | Yoshikawa | 335/213 X |

*Primary Examiner*—George Harris

*Attorney, Agent, or Firm*—Craig and Antonelli

[57] ABSTRACT

A deflection yoke comprises a core of magnetic material in the form of a frustum, having a large-diameter end and a small-diameter end and a coil. Two recesses are provided diameterically opposite to each other in the small-diameter end, and two projections having V-shaped concavities at their outer ends are provided diametrically opposite to each other at the large-diameter end. The coil is wound in a toroidal manner on the core, such that turns of the coil may pass on the edges of the recesses and the edge of the concavities of the projections in perpendicular relation therewith.

2 Claims, 5 Drawing Figures

DEFLECTION YOKE

This invention relates to a deflection yoke especially suitable for use in a television receiver.

As a deflection yoke for a color picture tube having in-line electron guns is used a so-called semi-toroidal deflection yoke comprising a horizontal deflection coil in the shape of a saddle and a vertical deflection coil in the shape of a toroid. In general, such a semi-toroidal deflection yoke is so designed as to produce a barrel-shaped magnetic field on the neck side of the picture tube and an intensified pincushion-shaped magnetic field on the face plate (screen) side of the picture tube by the horizontal deflection coil, that is, the horizontal deflection coil as a whole induces a pincushion magnetic field. On the other hand, the vertical deflection coil is so shaped and mounted as to produce a barrel-shaped magnetic field along the central axis thereof.

Therefore, when such a semi-toroidal deflection yoke is used for an in-line gun type color picture tube, its horizontal deflection coil as a whole produces a pincushion magnetic field and its vertical deflection coil induces a barrel-shaped magnetic field, so that the convergence of each beam is improved to eliminate color distortion. Further, with this type of a deflection yoke, since the horizontal deflection coil produces an intensified pincushion field on the face plate side of the yoke, the pincushion distortions near the upper and lower edges of the picture screen can be corrected. The reason for this is as follows: the horizontal components of the pincushion magnetic field attract the beam scanning the upper portion of the screen downward and the beam scanning the lower portion of the screen upward and also the beam attracting forces of the horizontal components increase toward the left and right edges of the screen. And the magnetic field produced by the horizontal deflection coil on the neck side of the yoke is a barrel-shaped one. This is because the misconvergence due to the intensified pincushion field produced by the horizontal deflection coil on the face plate side of the yoke must be corrected.

The above described deflection yoke usually has a horizontal deflection yoke on which the horizontal deflection coil is wound and a vertical deflection yoke on which the vertical deflection coil is wound. The yoke is a magnetic core in the shape of a truncated cone (hereafter referred to also as a frustum-shaped magnetic core) having a large-diameter end and a small-diameter end and a vertical deflection coil is wound on the magnetic core radially with respect to the central axis of the core. Namely, the vertical deflection coil is wound on the core in such a manner that each turn of the coil is substantially in a plane containing the central axis. With this vertical deflection yoke, the angle subtended by the width of the coil at the large-diameter end with respect to the central axis of the core is equal to the corresponding angle at the small-diameter end. Moreover, the plane containing the small-diameter end is parallel to that containing the large-diameter end and each turn of the coil is perpendicular to the edges of both the ends, so that the respective turns of the coil can be prevented from being erroneously displaced. In order for this coil to produce a barrel-shaped magnetic field, the winding angle should be made larger than 30°. The winding angle is defined as an angle between the straight line passing through the point of intersection between the central axis of the core and a plane cut in parallel to the diameter ends thereof and the middle point located in the middle of one of the two groups of the turns of the coil at that plane, and the straight line passing through the middle point and the center of gravity of the above mentioned group of the turns. As described above, according to the conventional vertical deflection yoke, the turns of the vertical deflection coil are disposed perpendicularly to the surfaces of the small- and large-diameter ends of the frustum-shaped magnetic core so that the position of the coil relative to the core may be kept fixed. However, the conventional vertical deflection yoke still has a drawback that pincushion distortions near the left and right edges of the picture screen cannot be corrected.

The present inventor has developed, to eliminate the pincushion distortions near the left and right edges of the picture screen without disturbing the convergence of the beams, a vertical deflection yoke with which the vertical deflection coil produces a barrel-shaped magnetic field on the neck side of the yoke and a pincushion-shaped magnetic field on the face plate side of the yoke. With this vertical deflection yoke, the vertical deflection coil must be so wound on the core that the angle subtended by the width of the coil at the small-diameter end with respect to the central axis of the core may be large and that the corresponding angle at the large-diameter end may be small. However, with such winding of the coil on the core, a plane formed by the coil on the edge surface of the core and the coil on the outer periphery of the core, (i.e., a plane formed by individual turns of the coil) is no longer perpendicular to the edge surface of the core.

As a result, the component of tensions exerted on the turns in the direction opposite to the edge surface, relative to a direction parallel to the edge surface will disadvantageously cause the turns of the coil to be displaced on the edge surface.

One object of this invention is to provide a new and useful deflection yoke free from the above described drawbacks incidental to the conventional yokes.

Another object of this invention is to provide a deflection yoke in which the angles formed between the whole turns of the coil (i.e., by the coil width) at the small- and large-diameter ends of the frustum-shaped magnetic core with respect to the central axis of the core are varied, but the turns of the coil are prevented from being displaced from their proper positions on the core.

The present invention will be apparent from the following detailed description taken in conjunction with the accompanying drawings, in which.

Before the explanation of embodiments of this invention, reference is made concerning the winding angle of a vertical deflection coil. In the case where a coil is wound in a toroidal manner on a frustum-shaped magnetic core having a large-diameter end and a small-diameter end, the winding angle at the large-diameter end is defined as an angle between the straight line passing through the point of intersection between the central axis of the core and the plane containing the large-diameter end and the middle point located in the middle of one of the two groups of the turns of the coil at the large diameter-end, and the straight line passing through the middle point and the center of gravity of the above mentioned group of the turns. The winding angle at the small-diameter end is similarly defined.

Figure 1:
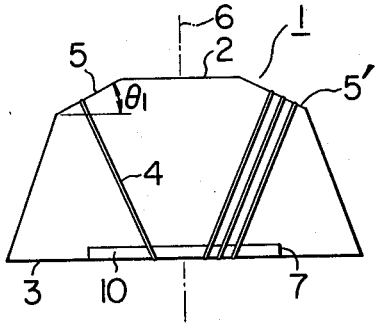
FIG. 1 is a side view of a vertical deflection yoke according to this invention.
Figure 2:
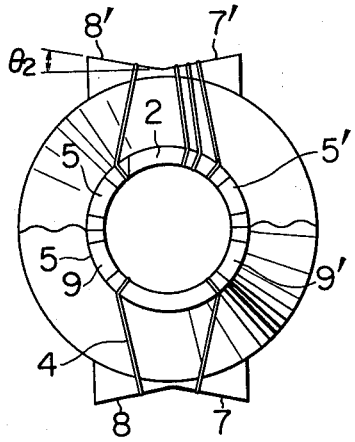
FIG. 2 is a plan view of the vertical deflection yoke shown in FIG. 1.
Figure 3:
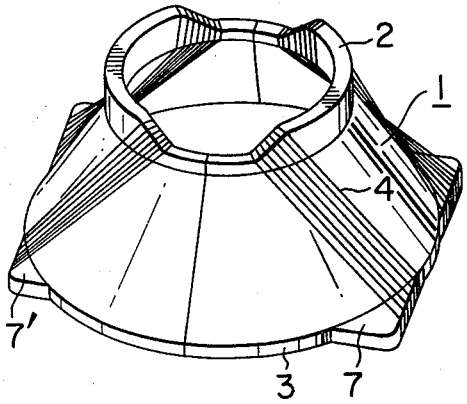
FIG. 3 is an oblique view of the vertical deflection yoke shown in FIG. 1.

FIGS. 1, 2 and 3 show a vertical deflection yoke embodying this invention, which is adapted to wind a vertical deflection coil 4 on a core 1 in such a manner that the induced magnetic field is of a barrel-shape near and at the small-diameter end 2 (on the neck side) of the yoke and of a pincushion-shape near and at the large-diameter end 3 (on the face plate side) of the yoke, that is, in a manner that the winding angles at the small-diameter end 2 are large while the winding angles at the large-diameter end 3 are small. The core 1 is made of magnetic material and has the shape of a frustum, having the small-diameter end 2 and the large-diameter end 3. The small-diameter end 2 has recesses 5 and 5' and the two sloping portions 9 and 9' of each of the recesses 5 and 5' make an angle $\theta_1$ with respect to the associated flat bottom portion, as shown in FIGS. 1 and 2. Moreover, the core 1 is provided with projections 7 and 7' made of magnetic material. The projections 7 and 7' are located diametically opposite to each other at the large-diameter end 3 and the plane containing the projections 7 and 7' is perpendicular to the central axis 6 of the core 1. The straight line passing the centers of the recesses 5 and 5' is perpendicular to the straight line passing the centers of the projections 7 and 7'. The outer end of each projection 7 or 7' is of center-depressed shape with sloping part 8 or 8' as shown in FIG. 2. It is now assumed that the sloping part 8 or 8' makes an angle $\theta_2$ with respect to a plane parallel to the plane containing the central axis 6 of the core 1 and the straight line passing the centers of the recesses 5 and 5'.

When the coil 4 is wound on the core 1 having the projections 7 and 7', the coil 4 is extended over the side wall of the core 1 between the sloping part of the recess 5 (or 5') and the sloping part 8 (or 8') of the projection 7 (or 7'). Now, if the above-defined angle $\theta_1$ is so selected that the individual turns of the coil 4 may make right angles with the edge 9 of the sloping part of the recess 5, the turns are pulled perpendicular to the sloping edge 9 so that the coil 4 is prevented from relatively moving along the edge 9. In like manner, if the angle $\theta_2$ defined above is so determined that the turns of the coil 4 make right angles with the edge 10 of the sloping part 8 of the projection 7, the coil 4 prevented from relatively moving along the edge 10 since also in this case the forces exerted on the turns of the coil 4 are always perpendicular to the edge 10.

As described above, with the embodiment of this invention shown in FIGS. 1 to 3, the coil 4 can be wound on the core 1 without positional deviation where the winding angle at the large-diameter end 3 is made smaller than the winding angle at the small-diameter end 2.

In the embodiment shown in FIGS. 1 to 3, the provision of the projections 7 and 7' intensifies the degree of the pincushion shape of the induced magnetic field. The reason for this is as follows. The magnetic field induced by the coil 4, which is oriented laterally within the core 1 shown in FIG. 2, tends to concentrate through the matter having small magnetic resistance and therefore is so bent as to pass through the projections 7 and 7', resulting in an intensified pincushion type magnetic field. Accordingly, the coil winding process can be facilitated since there is no need for making, with a great difficulty, the winding angle at the large-diameter end small to generate an intensified pincushion-shape field. Further, since the magnetic field near the projections 7 and 7' is much more pincushion-shaped, the pincushion distortions near the left and right edges of the picture screen can be effectively and sufficienlty corrected.

In the embodiment shown in FIGS. 1 to 3, it sometimes happens that the coil, when wound in several layers on the core, has its turns of some upper layer adversely displaced along the edges 9 and 9' of the recesses 5 and 5'.

Figure 4:
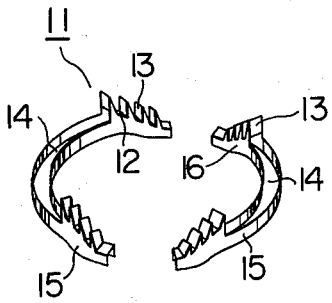
FIG. 4 is an oblique view of an auxiliary ring used for the vertical deflection yoke according to this invention.
Figure 5:
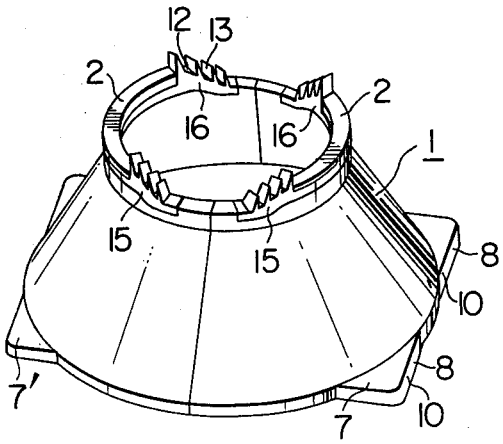
FIG. 5 shows in an oblique view a vertical deflection yoke embodying this invention, with the auxiliary ring shown in FIG. 4 attached thereto.

FIGS. 4 and 5 shows an improved embodiment which can prevent the adverse displacement of the coil. This embodiment uses an auxiliary ring 11 shown in FIG. 4, to solve the above problem. The auxiliary ring 11 is formed of, for example, synthetic resin and placed in contact with the sloping portions of the recesses 5 and 5'. The auxiliary ring 11 consists of portions 12 serving as formers for the coil, projecting portions 13 for separating turns wound on the former portions 12, hollows 14 in which the small-diameter end 2 of the core 1 is fitted, and side walls 15 and 16 for elastically fixing the ring 11 as a whole to the core 1. The assembled condition is as shown in FIG. 5, wherein every portion of the auxiliary ring 11 is seen as playing its role. Since the turns of the coil are wounded as divided between the projections 13 of the auxiliary ring 11, the adverse displacement of the coil is prevented. An attempt to provide projections like the projections 13 integrally on the sloping portions of the recesses 5 and 5' is not impossible, but it is difficult to shape magnetic material into the desired form. Accordingly, the ring 11 is formed of, for example, synthetic resin which has a high shapability.

Moreover, it may be considered that the use of a suitable auxiliary ring can eliminate the recesses 5 and 5', that is, that the auxiliary ring having flat contacting surfaces can be provided on the flat surface of the small-diameter end 2. In such a case, however, there arises a drawback that the deflection yoke as a whole becomes large. If the distance between the large-diameter end and the small-diameter end is reduced to lessen the size of the deflection yoke, a desired deflection sensitivity can be obtained only with an increase in the current through the coil. The increase in the coil current causes an increase in power loss and therefore the distance cannot be decreased. For this reason, this invention employs such an auxiliary ring as shown in FIGS. 4 and 5.

As described above, according to this invention, there can be provided a deflection yoke in which the coil is prevented from being displaced even where the winding angle at the large-diameter end is smaller than that at the small-diameter end.

What is claimed is:

1. A deflection yoke comprising a core of magnetic material in the form of a truncated cone having a large-diameter end and a small-diameter end, said small-diameter end having two recesses each having sloping portions, located diametically opposite to each other; projections provided at said large-diameter end, located diametically opposite to each other and extending out perpendicular to the axis of said core, the straight line passing through the centers of said recesses being perpendicular to the straight line passing through the centers of said projections, and the outer end of each of said projections having a symmetrical V-shaped concavity; and a coil wound in a toroidal manner on said core, passing on the edges of said sloping portions of said recesses of the small-diameter end and the edges of said V-shaped concavities of said projections.

2. A deflection yoke as claimed in claim 1, further comprising an auxiliary ring having coil former portions with sloping parts complementary in shape to said recesses and projections formed on said coil former portions, said auxiliary ring being disposed on said core in a manner that the rear surfaces of said coil former portions are kept in contact with the surfaces of said recesses and said coil being wound in a toroidal manner on said coil former portions, divided by said projections thereon.

* * * * *